United States Patent [19]

Heine

[11] 4,051,636

[45] Oct. 4, 1977

[54] METHOD AND APPARATUS FOR GRINDING TURBINE AND COMPRESSOR BLADES TO DIMENSION

[75] Inventor: Karlheinz Heine, Wasel, Germany

[73] Assignee: Siemens Aktiengesellschaft, Munich, Germany

[21] Appl. No.: 677,968

[22] Filed: Apr. 19, 1976

[30] Foreign Application Priority Data

Apr. 30, 1975 Germany ..... 2519190

[51] Int. Cl.[2] ..... B24B 21/16; B24B 41/00

[52] U.S. Cl. ..... 51/145 R; 51/240 R; 51/50 PC; 51/281 R; 90/13.3

[58] Field of Search ..... 51/50 PC, 141, 145 R, 51/101 R, 281 R, 281 C, 240 R; 90/13.3

[56] References Cited

U.S. PATENT DOCUMENTS

| | | | |
|---|---|---|---|
| 723,044 | 3/1903 | Seymour | 51/101 R |
| 2,388,555 | 11/1945 | Kvehni | 51/101 R |
| 3,376,764 | 4/1968 | Schardt | 51/240 R X |
| 3,973,360 | 8/1976 | Crevoisier | 51/145 R X |

*Primary Examiner*—Gary L. Smith

*Attorney, Agent, or Firm*—Kenyon & Kenyon, Reilly, Carr & Chapin

[57] ABSTRACT

For the purpose of grinding turbine and compressor blades to dimensions, a model blade and work piece are arranged one above the other in a support member which is supported on an air cushion to permit ease and freedom of motion in any direction, the model and work piece further being supported in the support means for simultaneous rotation about their respective longitudinal axes so that they can be brought against a grinding wheel and copy roll similarly disposed one above the other.

5 Claims, 3 Drawing Figures

METHOD AND APPARATUS FOR GRINDING TURBINE AND COMPRESSOR BLADES TO DIMENSION

BACKGROUND OF THE INVENTION

This invention relates to the grinding of blades for turbines, compressors and the like in general and more particularly to an improved method and apparatus for carrying out such grinding.

In blades of this nature, the accuracy of the profile and quality of the surface are prerequisites for proper operation and optimum efficiency. Normally, great analytical and experimental effort is expended in developing blade profiles for given operating conditions. In addition to the aerodynamic and thermodynamic aspects of the blades, vibration and strength considerations such as a narrow bandwidth of resonance frequencies resulting from the profile or minimal notch effects place stringent requirements on the profile tolerance and surface roughness of the blades.

In order to insure that these requirements are met, it is typical to follow fabrication of the blade using chip removing apparatus and non-chip removing apparatus with finishing operations such as grinding, wet sanding, ball blasting and so on. Of these various finishing operations, in practice, belt grinding has been found to be the most efficient for contour grinding as well as surface finishing. Thus, it alone or in conjunction with other processes is an integral part of blade production.

In the grinding processes presently in use, the work piece is pushed by hand against the abrasive belt which moves over a contact pulley with the proper grinding velocity. The guidance of the work piece and the feed motion are also carried out by hand. This requires great skill, particularly to obtain accurate contour grinding of blades with compound curvature to the proper dimensions. However, interruptions of the grinding operation for gauging are necessary. In addition, the development of heat and the normally relatively short distance from the abrasive belt to the operations hand holding the work piece require that the operator wear partial gloves for safety reasons. Additional problems are caused when handling large and thus, usually relatively heavy blades. The impairment of the touch of the operator because of the weight of the blades and the necessity of wearing gloves is a factor in the ability to obtain accurate grinding.

In view of these various problems, the need for an improved method and apparatus which permits grinding of blades, including those of large weight, to a proper dimension in a simple manner becomes evident.

SUMMARY OF THE INVENTION

The present invention solves this problem by using a method of duplicate copy grinding. In accordance with the present invention, a holder for the work piece is supported on an air cushion so that it is freely movable in the plane of its support, i.e., the horizontal plane. In this work piece holder, the work piece and a model or master blade are disposed one above the other with their axes parallel. Both the model and work piece are disposed to be rotatable about their axes with means coupling the model and work piece together so that they rotate together. Adjacent the work piece holder are disposed a grinding belt and copy wheel, one above the other, with the axes of the grinder and copy wheel in the same plane as the axes of the work piece and model respectively. Naturally, the belt grinder and copier roll have the same diameter.

With this arrangement, using the air cushion support and the ability to rotate the work piece and model, the blade to be ground, i.e., the work piece, can be brought against the belt grinder in any desired orientation Even if the work piece is of great weight, it is freely movable without physical effort because of the air cushion support. This arrangement insures accurate grinding to profile and dimension by means of the copy roller and model.

DETAILED DESCRIPTION OF THE PREFERRED EMBODIMENT

Figure 1:
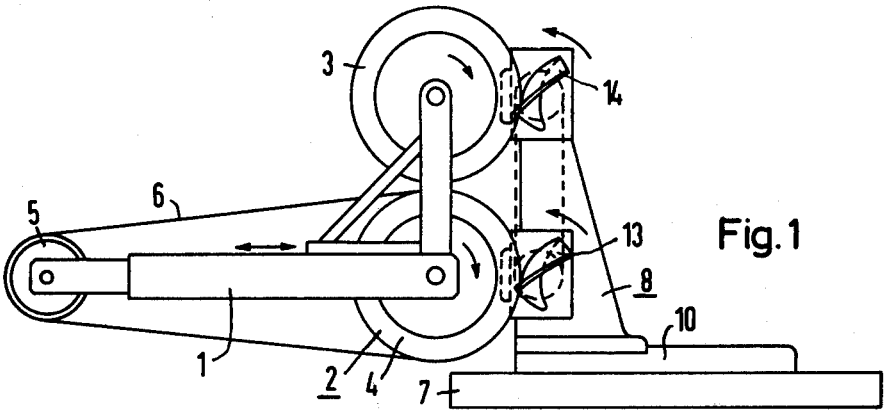
FIG. 1 is an elevation view of the apparatus of the present invention in the operating position.

As illustrated by FIG. 1, a belt grinder 2 and a copier wheel 3 are disposed on a stationary tool holder 1. The copier wheel and grinder 2 are disposed one above the other with their axes parallel. Both have the same diameter. The illustrated belt grinder 2 comprises a contact pulley 4 and drive pulley 5 over which an abrasive belt 6 is led under tension. The diameter of the contact pulley 4 and thickness of the abrasive belt 6 taken together result in a diameter exactly equal to that of the copier roller 3.

Figure 3:
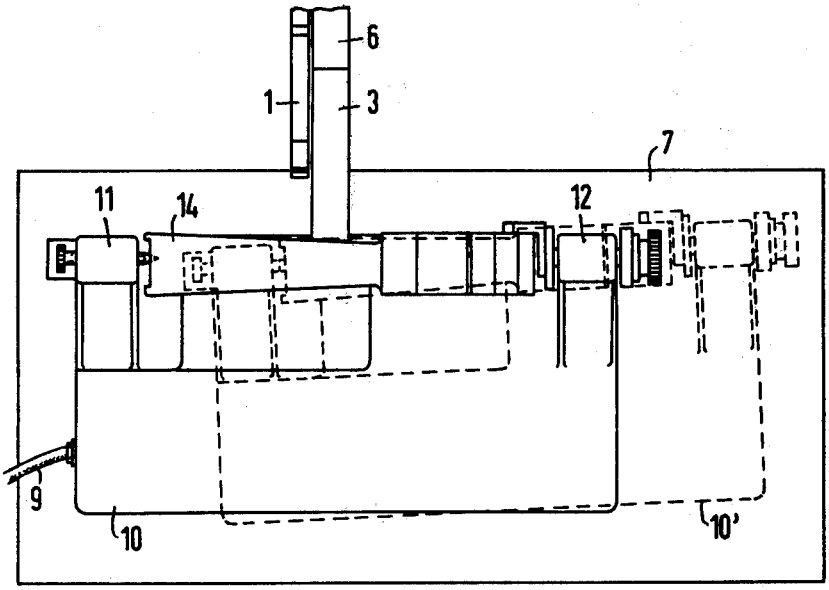
FIG. 3 is a plan view of the apparatus of FIGS. 1 and 2 showing in dotted lines the manner in which the work piece holder can be reoriented to a different position.

Disposed opposite the tool holder with the belt grinder and copier roller is the work piece holder 8. The work piece holder 8 is disposed on a base plate 10 which is supported on a table plate 7 by means of an air cushion. Shown on FIG. 3 is an air inlet 9 through which air is fed inside the plate 10 which contains a plurality of fine nozzles in its bottom to thereby build up an air cushion between the plates 10 and 7 so that the work piece holder 8 floats with small constant spacing above the plate 7.

Figure 2:
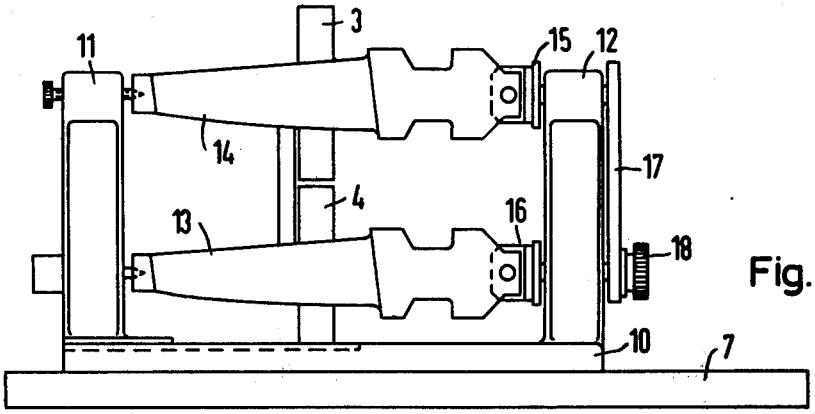
FIG. 2 is a side view of the apparatus of FIG. 1.

As is more clearly illustrated on FIG. 2, the work piece holder 8 includes two vertical supports 11 and 12. Between these supports there is disposed, with their axes parallel to each other and in the same horizontal planes as the axes of the grinding wheel and copier wheel, a work piece 13 and a model 14. The model 14 can be, for example, a master blade. The work piece 13 is a blade for a turbine, compressor or the like which is to be machined so that its dimensions match exactly those of the model 14. Both the model 14 and work piece 13 are disposed between the vertical supports 11 and 12 so as to be rotatable about their axes. At the righthand ends on FIG. 2 they are held by holders 15 and 16 disposed for rotation in the vertical member 12. These supports 15 and 16 have shafts extending through the vertical support 12 and terminating in pulley wheels of equal diameter which are coupled together by a serrated belt 17 or the like. Coupled to the lower pulley is a hand wheel 18 to permit rotating, simultaneously, the model 14 and work piece 13. This motion corresponds to the conventional tangential feed motion in grinding. Because of the air cushion between the base plate 10 and the guide plate 7, the work piece holder 8 can be moved in the horizontal plane essentially without friction. This degree of freedom permits grinding compound curvature blades by setting the holder 8 at any direction relative to the copier roller 3 and thus setting the work piece in the same relative position to the abrasive belt 6. As is illustrated by FIG. 3, in which a second position 10' is shown in dotted lines, the grinding belt 6 will always be in line contact with the work piece. Thus, in addition to greater chip removal, a substantially improved surface is achieved with the method and apparatus of the present invention.

Even for the largest blade weights, the work piece and holder can still be guided by hand along the copy roller using the apparatus according to the present invention. The rotary feeding motion of the blade can be accomplished manually as well as through a motor drive. The first method permits intermittent grinding.

The essential advantages of this new method of grinding are that the entire contour of the blade can be ground independently of the skill of the operator and without interruptions that are otherwise necessary for dimensional checking. In addition, the copying system prevents undergrinding of tolerance in both twisted and untwisted blades. This results in a greater uniformity for the profile accuracy over an entire production lot. As a result, there is greater uniformity of blades with respect to thermodynamic and vibrational characteristics, particularly in maintaining a narrow bandwidth of resonance. With the method and apparatus of the present invention, the weight and size of the blades have no effect on the ability to accurately grind.

Thus, an improved method and apparatus for grinding turbine and compressor blades has been described. It should be noted that the method and apparatus of the present invention can be used not only for grinding blades of turbines and compressors accurately to a dimension, but is also useful in grinding other work pieces which have an asymmetric profile and cannot be machined with conventional stationary copying methods. These and other modifications may be made without departing from the spirit of the invention, which is intended to be limited solely by the appended claims.

I claim:

1. A method for grinding turbine and compressor blades to dimension comprising:

a. disposing, on a stationary base, a copier roller and grinding belt of equal diameter one above the other with their axes parallel;

b. supporting a model blade and a work piece blade in a work piece holder one above the other with their axes parallel to each other, said model blade and work piece blade being supported therein for simultaneous rotation about their axes;

c. supporting said work piece holder on an air cushion so that it is freely movable in any direction in the horizontal plane; and d. bringing said model and work piece in contact with said copier roller and grinding belt.

2. The method of claim 1 and further including disposing the axes of the work piece and model in the same horizontal planes as the axes of the grinding belt and copier roller respectively.

3. Apparatus for grinding blades for turbines and compressors to dimension comprising:

a. A stationary tool holder;

b. a belt grinder rotatably disposed on said stationary tool holder;

c. a copier roller of the same diameter as said belt grinder rotatably disposed on said tool holder so as to be vertically spaced from said belt grinder with its axis parallel to the axis of said belt grinder;

d. a guide plate;

e. a work piece holder having a base plate disposed atop said guide plate, said work piece holder including means for supporting a model blade and a work piece such that they are simultaneously rotatable therein with their longitudinal axes parallel one on top of the other; and f. means for establishing an air cushion between said guide plate and the base plate of said work piece holder whereby said work piece holder can be easily moved in any direction in the horizontal plane.

4. Apparatus according to claim 3 wherein the axes of said work piece and model lie in the same horizontal planes as the axes of said belt grinder and copier roller respectively.

5. Apparatus according to claim 3 wherein said means for supporting comprise two spaced vertical supports attached to said base plates at least one having holders for said work piece and model blade rotatably supported therein and means coupling said holders for simultaneous rotation.

* * * * *